US009109530B2

(12) United States Patent
Bischofberger

(10) Patent No.: US 9,109,530 B2
(45) Date of Patent: Aug. 18, 2015

(54) PISTON FOR AN INTERNAL COMBUSTION ENGINE

(75) Inventor: Ulrich Bischofberger, Esslingen (DE)

(73) Assignee: MAHLE International GmbH, Stuttgart (DE)

( * ) Notice: Subject to any disclaimer, the term of this patent is extended or adjusted under 35 U.S.C. 154(b) by 0 days.

(21) Appl. No.: 14/130,584

(22) PCT Filed: Jul. 4, 2012

(86) PCT No.: PCT/DE2012/000670
§ 371 (c)(1),
(2), (4) Date: Jan. 28, 2014

(87) PCT Pub. No.: WO2013/004215
PCT Pub. Date: Jan. 10, 2013

(65) Prior Publication Data

US 2014/0290618 A1 Oct. 2, 2014

(30) Foreign Application Priority Data

Jul. 5, 2011 (DE) ..... 10 2011 106 562
Oct. 19, 2011 (DE) ..... 10 2011 116 332

(51) Int. Cl.
*F02F 3/00* (2006.01)
*F02F 3/16* (2006.01)
*F02F 3/22* (2006.01)
*F01P 3/10* (2006.01)

(52) U.S. Cl.
CPC ... *F02F 3/16* (2013.01); *F01P 3/10* (2013.01); *F02F 3/22* (2013.01)

(58) Field of Classification Search
CPC ..... F02F 3/22; F02F 3/16; F02F 2003/0007; F02F 3/00; F02F 3/20; F01P 3/10; F16J 1/09
USPC ..... 123/193.6, 193.1, 41.01, 41.16, 41.34, 123/41.1
See application file for complete search history.

(56) References Cited

U.S. PATENT DOCUMENTS 2,244,008 A 6/1941 Hazen et al.
3,349,672 A 10/1967 Meier et al.
8,011,288 B2 * 9/2011 Gniesmer et al. ..... 92/231
(Continued)

FOREIGN PATENT DOCUMENTS

AT 195 181 B 1/1958
DE 1 245 640 B 7/1967
(Continued)

OTHER PUBLICATIONS

International Search Report of PCT/DE2012/000670, mailed Dec. 11, 2012.
(Continued)

*Primary Examiner* — Lindsay Low
*Assistant Examiner* — Long T Tran
(74) *Attorney, Agent, or Firm* — Collard & Roe, P.C.

(57) ABSTRACT

The invention relates to a piston (10, 110, 210) for an internal combustion engine, comprising a piston head (11, 111, 211) and a piston skirt, the piston head (11, 111, 211) having a circumferential ring section (15, 115, 215) and a circumferential cooling channel (16, 116, 216) in the region of the ring section (15, 115, 215). The cooling channel has a cooling channel floor (17, 117, 217) and a cooling channel ceiling (18, 118, 218). According to the invention, the cooling channel (16, 116, 216) has a narrowing (20, 120, 220).

9 Claims, 2 Drawing Sheets

(56) References Cited

U.S. PATENT DOCUMENTS

Figure 2:
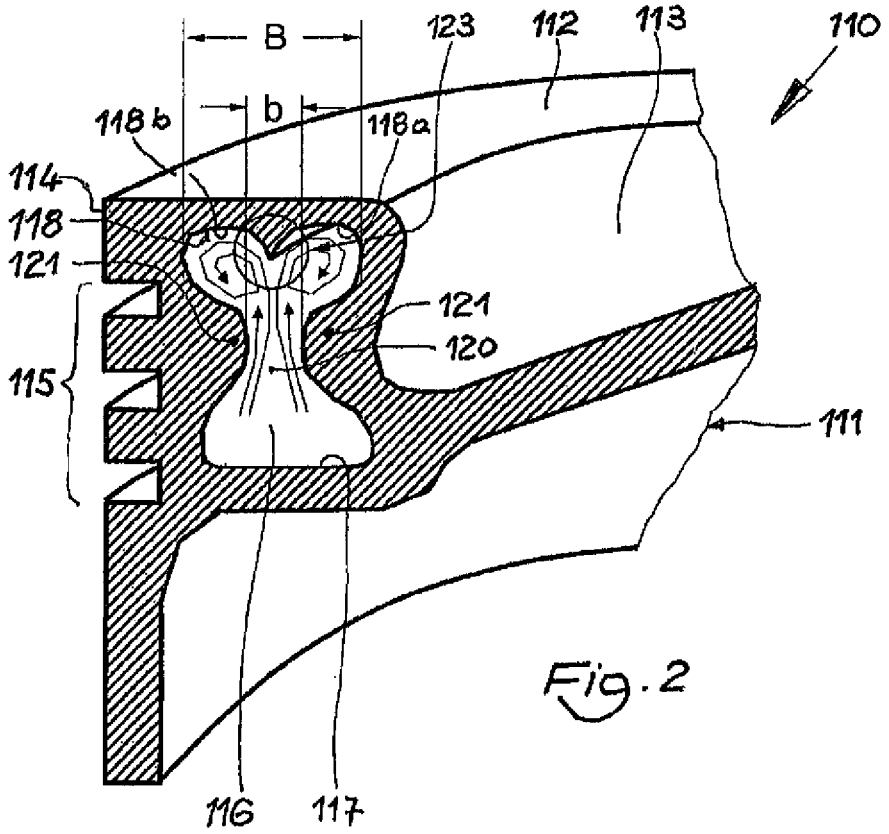

| | | | | |
|---|---|---|---|---|
| 8,065,984 | B2 | 11/2011 | Issler et al. | |
| 2010/0147250 | A1* | 6/2010 | Boczek et al. | 123/193.6 |
| 2012/0037111 | A1* | 2/2012 | Scharp et al. | 123/193.6 |
| 2012/0037115 | A1* | 2/2012 | Schnaiter et al. | 123/193.6 |
| 2012/0160204 | A1* | 6/2012 | Scharp et al. | 123/193.6 |
| 2013/0014722 | A1* | 1/2013 | Scharp et al. | 123/193.6 |
| 2014/0130767 | A1* | 5/2014 | Leitl | 123/193.6 |

FOREIGN PATENT DOCUMENTS

| | | | |
|---|---|---|---|
| DE | 17 51 342 | B1 | 6/1970 |
| DE | 37 07 462 | A1 | 9/1988 |
| DE | 40 18 252 | A1 | 12/1991 |
| DE | 10 2004 027 974 | A1 | 12/2005 |
| DE | 10 2006 053 179 | A1 | 5/2007 |
| DE | 10 2006 013 884 | A1 | 9/2007 |
| DE | 10 2006 022 413 | A1 | 11/2007 |
| JP | 2003-138984 | A | 5/2003 |
| JP | 2004-285942 | A | 10/2004 |
| JP | 2007-270813 | A | 10/2007 |
| JP | 2009-215978 | A | 9/2009 |
| WO | WO 2007054299 | A1 * | 5/2007 |

OTHER PUBLICATIONS

German Search Report dated Jan. 7, 2013 in German Application No. 10 2011 116 332.1 with English translation of relevant parts.

* cited by examiner

PISTON FOR AN INTERNAL COMBUSTION ENGINE

CROSS REFERENCE TO RELATED APPLICATIONS

This application is the National Stage of PCT/DE2012/000670 filed on Jul. 4, 2012, which claims priority under 35 U.S.C. §119 of German Application No. 10 2011 106 562.1 filed on Jul. 5, 2011 and German Application No. 10 2011 116 332.1 filed on Oct. 19, 2011, the disclosures of which are incorporated by reference. The international application under PCT article 21(2) was not published in English.

The present invention relates to a piston for an internal combustion engine, having a piston head and a piston skirt, wherein the piston head has a circumferential ring belt as well as a circumferential cooling channel in the region of the ring belt, and the piston skirt has a working surface assigned to its major thrust side and a working surface assigned to its minor thrust side.

Pistons of the stated type are exposed to great mechanical and particularly thermal stresses in modern internal combustion engines. For this reason, there is a fundamental need for constantly optimizing the cooling of the pistons, by means of feeding coolant into the cooling channel, particularly in the region of the piston crown.

The task of the present invention consists in further developing a piston of the stated type in such a manner that cooling is further improved in the region of the piston crown.

The solution consists in that the cooling channel has a narrowing.

The present invention is based on the continuity equation of fluid dynamics, according to which narrowing of the flow cross-section leads to an increase in the flow velocity in flowing fluids. In the piston according to the invention, the narrowing provided according to the invention, in interaction with the Shaker effect, brings about the result that coolant circulating in the cooling channel is not only thoroughly mixed, but also accelerated in targeted manner by means of the narrowing, and guided in the direction of the piston crown. This brings about the result that the thoroughly mixed and thereby cooled coolant is moved past the particularly hot wall sections of the cooling channel in the region of the piston crown significantly more efficiently and frequently per piston stroke than in the previously known pistons. Therefore the heat transfer coefficient between cooling channel wall and coolant is increased, and thereby the cooling of the piston according to the invention is significantly improved.

Advantageous further developments are evident from the dependent claims.

It is practical if the narrowing provided according to the invention has a distance from the cooling channel floor that corresponds to at least one-third of the axial height and/or at most two-thirds of the axial height of the cooling channel. In this way, particularly effective acceleration of the coolant stream in the direction of the cooling channel ceiling can be achieved. To optimize the acceleration, the narrowing preferably has essentially the same distance from the cooling channel floor and from the cooling channel ceiling.

It is practical if the narrowing is configured as a circumferential narrowing, in order to bring the acceleration effect about along the entire cooling channel.

A preferred further development provides that the narrowing is formed by means of precisely one material elevation on a cooling channel wall, and that the cooling channel ceiling is configured essentially in dome shape. With this, the result is achieved that the coolant is forced into a flow that circulates in circular shape, in the region of the cooling channel ceiling, so that it interacts with the wall of the cooling channel multiple times per piston stroke. In this connection, coolant at a lower temperature is always accelerated and additionally delivered by the narrowing. This effect is particularly effective if the radial dimension of the essentially dome-shaped cooling channel ceiling, at its widest point, is at least equal to twice the radial dimension of the narrowing. In this case, coolant that is less hot can flow downward, so that the flow of coolant at a lower temperature through the narrowing, in the direction of the cooling channel ceiling, is not significantly hindered.

A further preferred embodiment of the present invention consists in that the narrowing is formed by means of two material elevations that lie opposite one another on two cooling channel walls. This embodiment is particularly suitable in the case of multi-part friction-welded pistons, if the weld seam runs through the cooling channel, so that the weld beads form the material elevations that lie opposite one another and bring about the narrowing.

In this embodiment, it is particularly advantageous if the cooling channel ceiling has a flow divider at its zenith, which divider is disposed centered relative to the narrowing. In this case, the coolant, which flows through the narrowing in accelerated manner, is forced into two flows that rotate in opposite directions in the region of the cooling channel ceiling, which flows can interact with the wall of the cooling channel multiple times per piston stroke. In this connection, coolant at a lower temperature is constantly accelerated and additionally delivered by the narrowing. This effect is particularly effective if the radial dimension of the cooling channel ceiling, at its widest point, is at least equal to twice the radial dimension of the narrowing. In this case, coolant that is less hot can flow downward, so that the flow of coolant at a lower temperature through the narrowing is not significantly hindered.

To optimize this effect, the regions of the cooling channel ceiling that follow the flow divider can additionally be configured in arc shape or circle shape in cross-section. Furthermore, it is particularly practical to configure the flow divider to be V-shaped or cone-shaped in cross-section.

To further optimize the flow conditions in the cooling channel, the cooling channel wall adjacent to the ring belt can be configured to be vertical or inclined at a slant inward.

Another preferred embodiment of the present invention consists in that the narrowing is formed by precisely two material elevations, axially offset relative to one another, on two cooling channel walls. This embodiment leads to the result that an outer widening is formed in the region of the cooling channel ceiling, adjacent to the ring belt and/or to the top land, and an inner widening is formed in the region of the cooling channel floor, oriented relative to the piston crown center, particularly adjacent to a combustion bowl that might be present. In this way, these regions of the piston head, which are under particularly great thermal stress, are very effectively cooled.

In this embodiment, the cooling effect can be influenced, for example, in that the two material elevations have a different thickness, so that the two widenings are configured with differently large radii. The widening having the greater radius can then be disposed in the region of the greatest thermal stress of the piston head.

The present invention is suitable for all piston types and all piston constructions, and can be implemented with every piston material.

Figure 1:
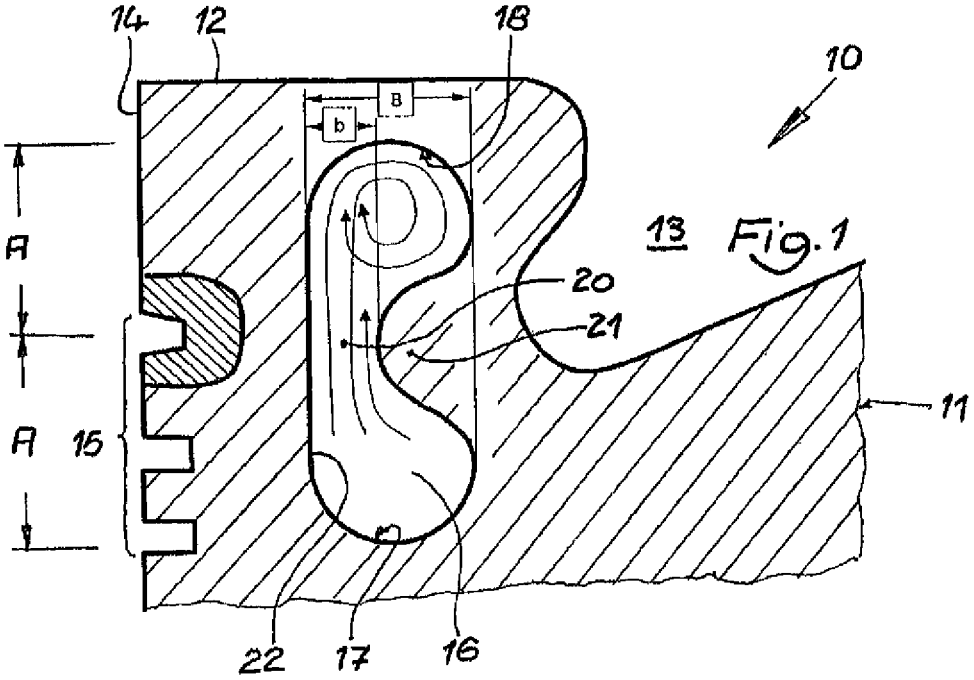
Figure 3:
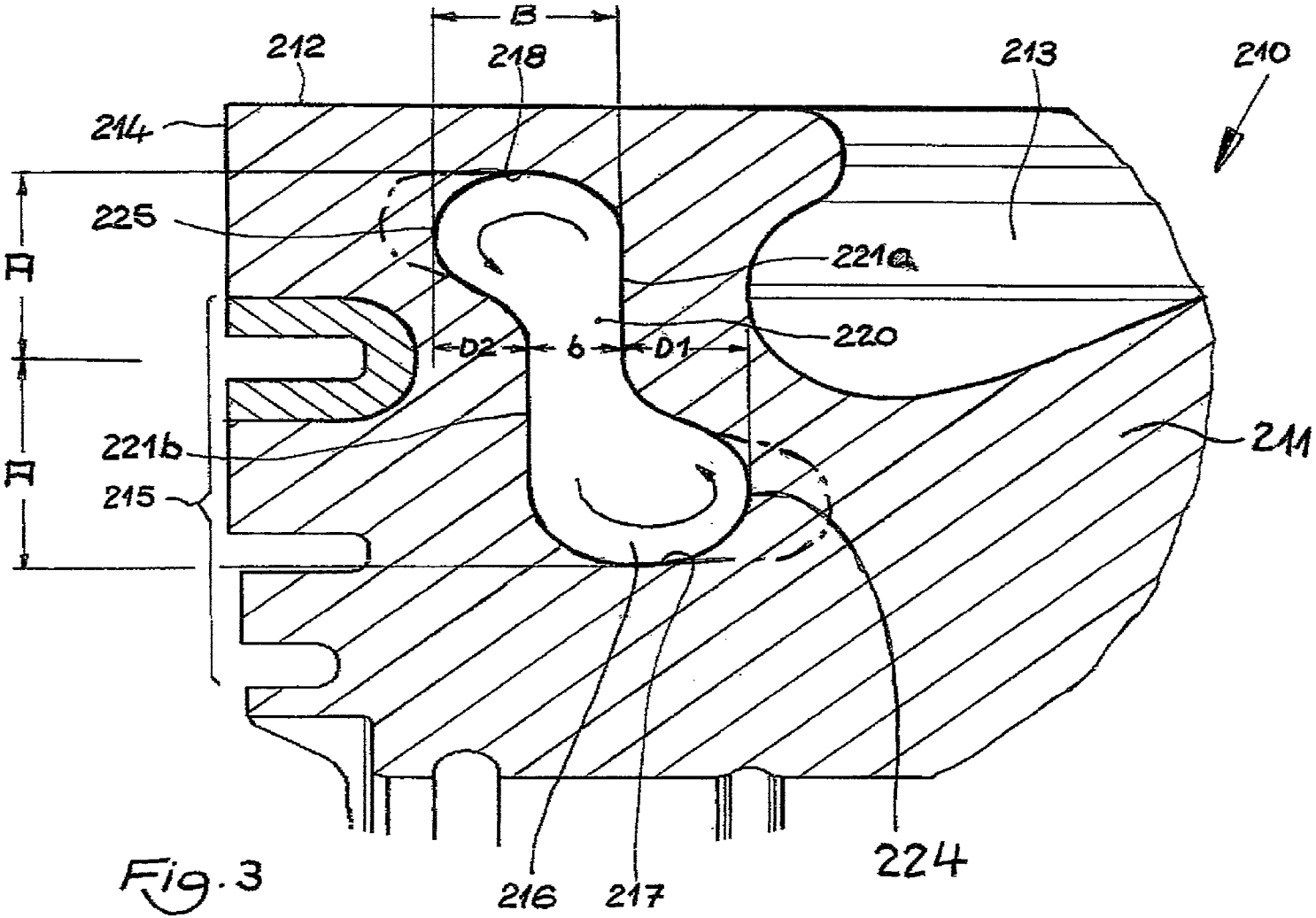

Exemplary embodiments of the present invention will be explained in greater detail below, using the attached drawings. These show, in a schematic representation, not true to scale:

FIG. 1 a first exemplary embodiment of a piston according to the invention, in a partial representation, in section;

FIG. 2 a further exemplary embodiment of a piston according to the invention, in a perspective partial representation, in section;

FIG. 3 a further exemplary embodiment of a piston according to the invention, in a partial representation, in section.

FIG. 1 shows a first exemplary embodiment of a piston 10 according to the invention. The piston 10 can be a one-part or multi-part piston. The piston 10 can be produced from a steel material and/or a light-metal material. FIG. 1 shows a one-part piston head 11 of a piston 10 according to the invention, as an example. The piston head 11 has a piston crown 12 having a combustion bowl 13, a circumferential top land 14, and a ring belt 15 for accommodating piston rings (not shown). A circumferential cooling channel 16 having a cooling channel floor 17 and a cooling channel ceiling 18 is provided at the level of the ring belt 15. The piston 10 furthermore has a piston skirt, in known manner, which can be configured in one piece with the piston head 11 or as a separate component, and is connected with the piston head 11 firmly, in known manner, or in the manner of an articulated piston, for example (not shown). In this exemplary embodiment of the present invention, the cooling channel 16 has a circumferential narrowing 20. In this exemplary embodiment, the narrowing 20 is formed by precisely one material elevation 21 in the cooling channel wall adjacent to the combustion bowl 13. In this exemplary embodiment, the cooling channel wall 22 adjacent to the ring belt 15 is configured to be essentially vertical. It can also be configured to be inclined at a slight slant inward, i.e. in the direction of the combustion bowl 13.

The cooling channel ceiling 18 of the cooling channel 16 is configured essentially in dome shape. In this exemplary embodiment, the narrowing 20 has essentially the same distance A from the cooling channel floor 17 and from the cooling channel ceiling 18 at its narrowest point. In the end result, the coolant is forced into a flow that circulates in a circle, in the region of the cooling channel ceiling 18, as indicated by the circular arrows, so that the coolant can interact with the wall of the cooling channel, in the region of the piston crown 12 and of the combustion bowl 13, multiple times per piston stroke. In this connection, coolant at a lower temperature is constantly accelerated and additionally delivered through the narrowing 20. To optimize this effect, in this exemplary embodiment the radial dimension B of the essentially dome-shaped cooling channel ceiling 18, at its widest point, is at least equal to twice the radial dimension b of the narrowing 20, in other words $B \geq 2 \times b$. In this case, coolant that is less hot can flow downward, so that the flow of coolant at a lower temperature through the narrowing 20, in the direction of the cooling channel ceiling 18, is not significantly hindered.

The piston 10 or the upper piston part 11 according to the invention can be produced, in known manner, by means of casting, forging, sintering, etc. In a one-piece upper piston part 11 as shown in FIG. 1, the cooling channel configured according to the invention can be produced, in known manner, by means of casting with a salt core.

FIG. 2 shows a further exemplary embodiment of a piston 110 according to the invention. The piston 110 can be a one-part or multi-part piston. The piston 110 can be produced from a steel material and/or a light-metal material. FIG. 2 shows a one-part piston head 111 of a piston 110 according to the invention, as an example. The piston head 111 has a piston crown 112 having a combustion bowl 113, a circumferential top land 114, and a ring belt 115 for accommodating piston rings (not shown). A circumferential cooling channel 116 having a cooling channel floor 117 and a cooling channel ceiling 118 is provided at the level of the ring belt 115. The piston 110 furthermore has a piston skirt, in known manner, which can be configured in one piece with the piston head 111 or as a separate component, and is connected with the piston head 111 firmly, in known manner, or in the manner of an articulated piston, for example (not shown).

In this exemplary embodiment of the present invention, the cooling channel 116 has a circumferential narrowing 120. In this exemplary embodiment, the narrowing 120 is formed by precisely two material elevations 121, which lie opposite one another, in the two cooling channel walls adjacent to the combustion bowl 113 and the ring belt 115, respectively.

In this exemplary embodiment, the cooling channel ceiling 118 of the cooling channel 116 has a flow divider 123 at its zenith, which divider is disposed centered relative to the narrowing 120. In this exemplary embodiment, the distance of the narrowing 120 from the cooling channel floor 117 is approximately precisely as great as the distance of the narrowing 120 from the cooling channel ceiling 118. In the end result, the coolant that flows through the narrowing 120, in accelerated manner, is forced into two flows that rotate in opposite directions, in the region of the cooling channel ceiling 118, as indicated by the circular arrows that run in opposite directions, so that the coolant can interact with the wall of the cooling channel 116, in the region of the piston crown 112 and of the combustion bowl 113, multiple times per piston stroke. In this connection, coolant at a lower temperature is constantly accelerated and additionally delivered through the narrowing 120. To optimize this effect, in this exemplary embodiment the radial dimension B of the cooling channel ceiling 118, at its widest point, is at least equal to twice the radial dimension b of the narrowing 120, in other words $B \geq 2 \times b$. In this case, coolant that is less hot can flow downward, so that the flow of coolant at a lower temperature through the narrowing 120, in the direction of the cooling channel ceiling 118, is not significantly hindered.

To optimize this effect, in this exemplary embodiment the regions 118*a*, 118*b* of the cooling channel ceiling 118 that follow the flow divider 123 are configured to be arc-shaped or circular in cross-section, and the flow divider 123 is configured to be V-shaped in cross-section.

The piston 110 or the upper piston part 111 according to the invention can be produced, in known manner, by means of casting, forging, sintering, etc. In a one-piece upper piston part 111 as shown in FIG. 2, the cooling channel 116 configured according to the invention can be produced, in known manner, by means of casting with a salt core. If the upper piston part 111 is configured in two parts and the two parts are connected with one another by means of friction welding, the friction-welding seam can be laid through the cooling channel 116, so that material elevations 121 that lie opposite one another and bring about the narrowing 120 can be formed by friction-welding beads, as they occur, in known manner, during the friction-welding process.

FIG. 3 shows a further exemplary embodiment of a piston 210 according to the invention. The piston 210 can be a one-part or multi-part piston. The piston 210 can be produced from a steel material and/or a light-metal material. FIG. 3 shows a one-part piston head 211 of a piston 210 according to the invention, as an example. The piston head 211 has a piston crown 212 having a combustion bowl 213, a circumferential top land 214, and a ring belt 215 for accommodating piston rings (not shown). A circumferential cooling channel 216 having a cooling channel floor 217 and a cooling channel ceiling 218 is provided at the level of the ring belt 215. The piston 210 furthermore has a piston skirt, in known manner, which can be configured in one piece with the piston head 211 or as a separate component, and is connected with the piston head 211 firmly, in known manner, or in the manner of an articulated piston, for example (not shown).

In this exemplary embodiment of the present invention, the cooling channel 216 has a circumferential narrowing 220. In this exemplary embodiment, the narrowing 220 is formed by precisely two material elevations 221*a*, 221*b*, disposed axially offset from one another, in the two cooling channel walls adjacent to the combustion bowl 213 and the ring belt 215, respectively. As a result, an inner widening 224 that extends to the combustion bowl 213 is formed in the region of the cooling channel floor 217. Furthermore, an outer widening 225 that extends to the uppermost ring groove of the ring belt 215 and to the top land 214 is formed in the region of the cooling channel ceiling 218. This leads to the result that in engine operation, these regions of the piston head 211, which are under particularly great thermal stress, namely the piston crown 212 in the region of the combustion bowl 213 and of the top land 214, are cooled very effectively. This cooling effect is also influenced, in this exemplary embodiment, in that the material elevation 221*a* has a thickness D1 that is greater than the thickness D2 of the material elevation 221*b*. Consequently, the inner widening 224 has a greater radius than the outer widening 225. Accordingly, the region of the combustion bowl is cooled particularly effectively during engine operation. Of course, the material elevation 221*b* can also have a greater thickness than the material elevation 221*a*, so that in this case, the outer widening 225 has a greater radius than the inner widening 224, and consequently the region of the piston crown 213 and of the top land 214 is cooled particularly effectively (not shown).

Within the scope of what is possible in terms of design, the widenings 224, 225 can extend to any desired degree in the radial direction, inward or outward, respectively, as indicated with a dot-dash line in FIG. 3.

The cooling channel floor 217 and the cooling channel ceiling 218 of the cooling channel 216 are configured essentially in dome shape. In this exemplary embodiment, the narrowing 220, at its narrowest point, has essentially the same distance A from the cooling channel floor 217 and from the cooling channel ceiling 218. In the end result, the coolant is forced into a flow that circulates in circle shape, counterclockwise, in the region of the cooling channel floor 217 and in the region of the cooling channel ceiling 218, as indicated by the circular arrows. Thus, the coolant can interact with the wall of the cooling channel, in the region of the piston crown 212 and of the combustion bowl 213, multiple times per piston stroke. In this connection, coolant at a lower temperature is constantly accelerated and additionally delivered through the narrowing 220. To optimize this effect, in this exemplary embodiment the radial dimension B of the inner widening 224 and of the outer widening 225, respectively, at its widest point, in each instance, is at least equal to twice the radial dimension b of the narrowing 220, in other words $B \geq 2 \times b$, as shown in FIG. 3 using the example of the outer widening 225. In this case, coolant that is less hot can flow downward, so that the flow of coolant at a lower temperature through the narrowing 220, in the direction of the cooling channel ceiling 218, is not significantly hindered. Because, at the same time, part of the fresh coolant at a lower temperature circulates in a circular flow in the region of the cooling channel floor, instead of flowing upward through the narrowing 220, whereby this coolant is not excessively heated by hot coolant flowing back out of the region of the cooling channel ceiling 218, the region of the combustion bowl is also effectively cooled.

The piston 210 or the upper piston part 211 according to the invention can be produced, in known manner, by means of casting, forging, sintering, etc. In a one-piece upper piston part 211 as shown in FIG. 3, the cooling channel 216 configured according to the invention can be produced, in known manner, by means of casting with a salt core.

The invention claimed is:

1. A piston (110) for an internal combustion engine, having a piston head (111) and a piston skirt, wherein the piston head (111) has a circumferential ring belt (115) as well as a circumferential cooling channel (116) in the region of the ring belt (115), having a cooling channel floor (117) and a cooling channel ceiling (118), wherein the cooling channel (116) has a circumferential narrowing (120) formed by precisely two material elevations (121) that lie opposite one another on two cooling channel walls, and wherein the cooling channel ceiling (118) has a flow divider (123) at its zenith, which divider is disposed centered relative to the narrowing (120).

2. The piston according to claim 1, wherein the regions (118*a*, 118*b*) of the cooling channel ceiling (118) that follow the flow divider (123) are configured to be arc-shaped or circular in cross-section.

3. The piston according to claim 1, wherein the flow divider (123) is configured to be V-shaped or conical in cross-section.

4. The piston according to claim 1, wherein the radial dimension (B) of the cooling channel ceiling (118), at its widest point, is at least equal to twice the radial dimension (b) of the narrowing (120).

5. The piston according to claim 1, wherein the narrowing (120) has a distance from the cooling channel floor (117) that corresponds to at least one-third of the actual height of the cooling channel (120).

6. The piston according to claim 1, wherein the narrowing (120) has a distance from the cooling channel floor (117) that corresponds to at most two-thirds of the actual height of the cooling channel (120).

7. The piston according to claim 1, wherein the narrowing (120) has the same distance (A) from the cooling channel floor (117) and from the cooling channel ceiling (118).

8. A piston (210) for an internal combustion engine, having a piston head (211) and a piston skirt, wherein the piston head (211) has a circumferential ring belt (215) as well as a circumferential cooling channel (216) in the region of the ring belt (215), having a cooling channel floor (217) and a cooling channel ceiling (218), wherein the cooling channel (216) has a circumferential narrowing (220) formed by precisely two material elevations (221*a*, 221*b*) in a material of the piston, the elevations being disposed axially offset relative to one another on two cooling channel walls, wherein an inner widening (224) that extends to a combustion bowl (213) is formed in the region of the cooling channel floor (217), and wherein an outer widening (225) that extends to a uppermost ring groove of the ring belt (215) and to a top land (214) is formed in the region of the cooling channel ceiling (218), and wherein the narrowing (220) has a distance from the cooling channel floor (217) that corresponds to at most two-thirds of the actual height of the cooling channel (220).

9. The piston according to claim 8, wherein the two material elevations (221*a*, 221*b*) have a different thickness.

* * * * *